United States Patent [19]

Decker

[11] 4,008,794

[45] Feb. 22, 1977

[54] TYPE CARRIER PRINT DEFLECTION BLOCKING MEANS FOR A SINGLE-ELEMENT PRINTER

[75] Inventor: Herbert Decker, Lauf, Germany

[73] Assignee: Triumph Werke Nurnberg A.G., Nurnberg, Germany

[22] Filed: Nov. 10, 1975

[21] Appl. No.: 630,270

[30] Foreign Application Priority Data

Jan. 16, 1975 Germany ..... 2501577

[52] U.S. Cl. ..... 197/55; 197/52

[51] Int. Cl.[2] ..... B41J 1/60

[58] Field of Search ..... 197/16, 18, 52, 55; 178/34

[56] References Cited

UNITED STATES PATENTS

| | | | |
|---|---|---|---|
| 3,286,806 | 11/1966 | Schoenfelder | 197/16 |
| 3,837,457 | 9/1974 | Anglin et al. | 197/55 X |
| 3,838,764 | 10/1974 | Decker | 197/55 X |
| 3,892,304 | 7/1965 | Shakib | 197/55 X |
| 3,924,726 | 12/1975 | Decker | 197/55 |

FOREIGN PATENTS OR APPLICATIONS

| | | |
|---|---|---|
| 2,218,310 | 10/1973 | Germany |

OTHER PUBLICATIONS

IBM Tech. Disc. Bulletin, by D. K. Gibson, vol. 8, No. 7, Dec. 1965, pp. 1008–1009.

IBM Tech. Disc. Bulletin, by R. D. Mathews, vol. 15, No. 2, July 1972, pp. 611–612.

*Primary Examiner*—Edgar S. Burr
*Assistant Examiner*—Paul T. Sewell
*Attorney, Agent, or Firm*—Joseph R. Spalla

[57] ABSTRACT

A single-element type carrier printing mechanism is provided with an element movable to block tangential deflection of the type carrier at printing impact with the platen, is normally disengaged from frictional contact with the type carrier during rotational positioning of the type carrier. The deflection blocking element includes a blocking arm pivotally mounted for free rotation relative to the type carrier, provided with an abutment adapted to act against a blocking surface formed on the type carrier. The blocking arm is also provided with teeth for detent engagement with a tilt detent device which moves the blocking arm from its normally disengaged position into engagement with the blocking surface to prevent impact deflection.

7 Claims, 5 Drawing Figures

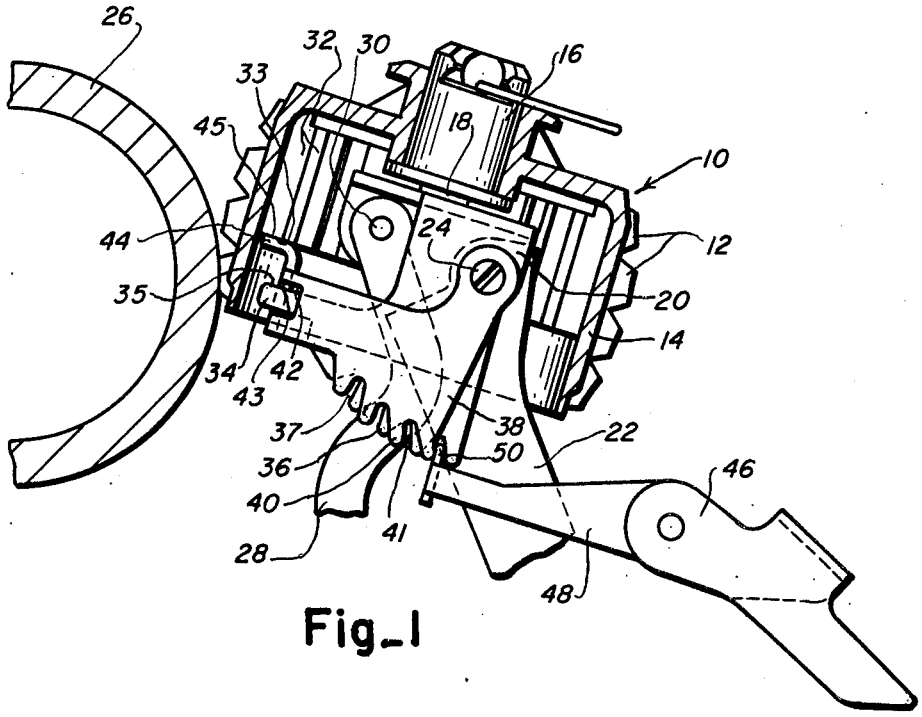
Fig_1
Fig_2
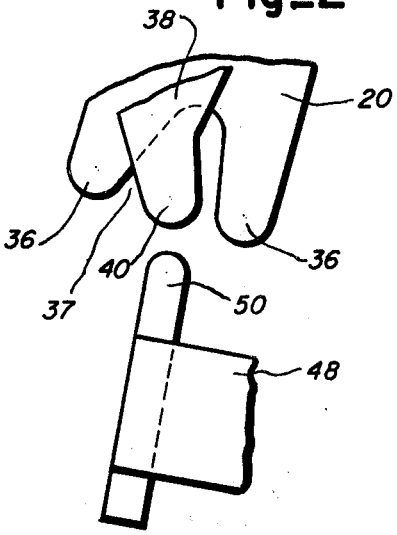
Fig_3
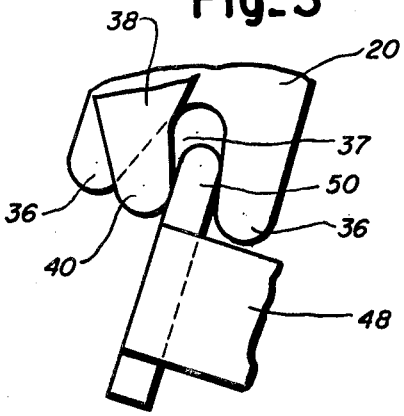
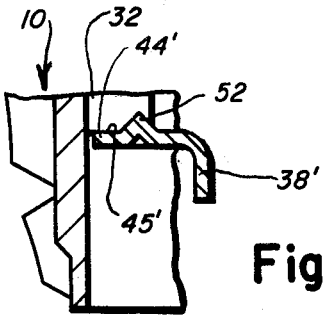
Fig_4
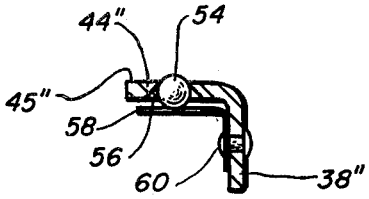
Fig_5

TYPE CARRIER PRINT DEFLECTION BLOCKING MEANS FOR A SINGLE-ELEMENT PRINTER

BACKGROUND OF THE INVENTION

The invention relates to a single-element printer for a typewriter and more particularly to an arrangement for preventing deflection of the type carrier during printing impact with the typewriter platen.

This invention is an improvement of the single-element type carrier support apparatus described in pending U.S. patent application, Ser. No. 350,523, filed Apr. 12, 1972, invented by Herbert Decker, and now U.S. Pat. No. 3,924,726 wherein there is disclosed a typehead support which includes a support member having a projecting abutment adapted to act against a support surface formed on the type carrier to preclude downward tangential movement of the type carrier resulting from a component of the impacting force, thereby to prevent blurring or smearing of the printed type character. While the apparatus achieves its intended purpose, it has been found that friction which develops between the support member and the support surface of the type carrier has an undesirable effect during the rotational positioning motion of the type carrier. One suggested solution to this problem is to leave an air gap between these two surfaces. This solution, however, would have a disadvantageous effect on the quality of the typing.

SUMMARY OF THE INVENTION

A single-element type carrier printing mechanism is provided with means which block deflection of the type carrier at printing impact with the platen, yet which are disengaged from frictional contact with the type carrier during rotational positioning of the type carrier. The deflection blocking means includes a blocking arm pivotally mounted for free rotation relative to the type carrier, the arm having an abutment adapted to act against a blocking surface formed on the type carrier and teeth for detent engagement with a detent means which selectively engage the blocking arm with the blocking surface to prevent impact deflection or which allow disengagement of the arm from the blocking surface to allow frictionless rotational positioning of the type carrier.

A recess is provided in the arm for the receipt of a finger extending from a tilt bridge rotatably supporting the type carrier. The recess and finger are dimensioned and configured to provide substantial play therebetween. The tilt bridge is also provided with teeth for detent engagement with the detent means. When the type carrier is in the non-printing position, the blocking arm is pivoted downwardly under its own weight so that the upper surface of the recess in the arm rests against the upper surface of the finger. In this position, the abutment on the blocking arm is disengaged from the blocking surface on the type carrier and the type carrier may thus be rotationally positioned free from frictional contact with the blocking arm. Also in this position, the teeth on the blocking arm are positioned so as to protrude into the gaps defined by the recesses between the detent teeth on the tilt bridge. When the type carrier is positioned for printing and is being driven to print, the detent means acts against the teeth on the blocking arm to drive the blocking arm upwardly and outwardly, pivoting the arm so that the abutment engages the blocking surface on the type carrier, preventing tangential escape of the type carrier on impact, and thus preventing blurring or smearing of the printed character.

Additionally, the detent means moves between the tilt bridge teeth and the teeth on the blocking arm to finally and precisely tilt position the type carrier to print the desired character.

OBJECTS OF THE INVENTION

An object of the invention is to block the downward tangential motion of the type carrier incident to impact to prevent blurring or smearing of the printed type character during printing, yet to permit friction-free rotational positioning of the type carrier.

It is an additional object of the invention to support the type carrier during its downward tangential motion by means which are simple, accurate and trouble-free.

Other objects and many of the attendant advantages of the present invention will become apparent to those skilled in the art from a reading of the following detailed description taken in conjunction with the accompanying drawing wherein like reference characters designate like parts and primed reference characters designate equivalent parts and wherein:

BRIEF DESCRIPTION OF THE DRAWING

FIG. 1 is a partial cross-sectional view of the type carrier head and type carrier support means shown in print impacting position;

FIG. 2 is a detail showing the final tilt positioning and print deflection blocking detent means in non-impacting position;

FIG. 3 is a detail showing the final tilt positioning and print deflection blocking detent means in print impacting position;

FIG. 4 is a cross-sectional detail of the type carrier support means engaging the type carrier head illustrating an embodiment wherein the type carrier print deflection blocking means is provided with rotational detent means; and FIG. 5 is a cross-section of an additional embodiment of the type carrier print deflection blocking means having an alternative rotational detent means provided therein.

DETAILED DESCRIPTION OF THE INVENTION

Referring to FIG. 1 of the drawing, a type carrier, generally indicated by numeral 10, is shown having generally inverted hollow cylinder or barrel shape and having vertical columns and horizontal rows of raised type characters 12 spaced around the outer periphery of the type carrier wall 14.

Type carrier 10 is supported on arbor 16 fixed on shaft 18 rotatably mounted on tilt bridge 20 which is pivotally mounted on forked impact arm 22 by means of pivot pin 24 defining a tilt axis for tiltably positioning type carrier 10 to present the desired row of type to the face of platen 26. A tilt positioning arm 28, pivotally connected with tilt bridge 20 by means of pivot pin 30, is connected with means not shown to tilt the type carrier to a selected row position.

Type carrier 10 is also keyed to arbor 16 for rotational positioning to present the desired column of type opposite platen 26.

On command, type carrier 10 is rotationally positioned by conventional means not shown and finally positioned by a rotate detent (not shown) associated with rotational detent teeth 32 formed at the internal surface of type carrier wall 14. At the same time, the type carrier is tiltably positioned by forces transmitted through arm 28 to pivot tilt bridge 20 and thereby tilt the type carrier, and is impacted against platen 26 by the movement of arm 22. The rotational positioning, tilt positioning and impacting means form no part of the invention and may be any conventional means such as that described in U.S. Pat. Nos. 3,825,102 and 3,838,764 by the same inventor.

Tilt bridge 20 is provided with a finger 34 extending laterally toward the platen and also with downwardly extending teeth 36 forming recesses 37 therebetween. A print deflection blocking arm 38 is mounted for free rotation about pivot pin 24. Print deflection blocking arm 38 is similarly provided with downwardly extending teeth 40 forming recesses 41 therebetween, and is also provided with a recess 42 and abutment 44. Recess 42 of print deflection blocking arm 38 has a configuration and a dimension significantly greater than the width of finger 34 of tilt bridge 20 to accept finger 34 extending therethrough so as to accommodate a substantial amount of play between print deflection blocking arm 38 and tilt bridge 20. Abutment 44 of print deflection blocking arm 38 extends laterally and upwardly from the print deflection blocking arm and presents an upper surface 45 which is adapted to cooperate with a lower print deflection blocking surface 33 formed by the lower extremities of rotation detent teeth 32. Also shown in FIG. 1 is a pivot lever 46 which pivotally supports a detent arm 48 carrying a final tilt positioning detent tooth 50, adapted to cooperate with teeth 36, 40 and recesses 37, 41 of tilt bridge 20 and print deflection blocking arm 38. Pivot lever 46, together with detent arm 48 and detent tooth 50, are positioned by conventional means not shown to cooperate with tilt bridge 20 and print deflection blocking arm 38 to accurately finally tilt position and support type carrier 10 to print a preselected type character 12, as explained further herein.

Prior to rotational and initial tilt indexing of type carrier 10 and to impacting of the type carrier with the platen, pivot lever 46 is positioned so that, as shown in FIG. 2, detent arm 48 maintains final tilt positioning detent tooth 50 in disengaged or non-contacting relation with teeth 36, 40 of tilt bridge 20 and print deflection blocking arm 38. In this position, print deflection blocking arm 38, due to gravity and to the free pivotal connection around pivot pin 24, rests in a downward or unengaged position, with the upper surface 43 of recess 42 of print deflection blocking arm 38 resting on the upper surface 35 of finger 34 of tilt bridge 20. In this position, teeth 40 of print deflection blocking arm 38 extend into the gaps defined by recesses 37 formed by teeth 36 of tilt bridge 20. Also in this position, abutment 44 of print deflection blocking arm 38 is lowered out of frictional engagement with lower print deflection blocking surface 33 defined by the lower extremities of rotation detent teeth 32.

In operation, to print a preselected type character, type carrier 10 is rotatively positioned by means not shown to present to the face of platen 26 the column of type on which the preselected character is located. Since print deflection blocking arm 38 is in the downward or rest position with upper surface 43 of recess 42 of print deflection blocking arm 38 resting on upper surface 35 of finger 34 of tilt bridge 20, type carrier 10 is free to rotate without frictional engagement between upper surface 45 of abutment 44 of print deflection blocking arm 38 and print deflection blocking surface 33 of rotation detent teeth 32.

At the same time, type carrier 10 is tilt positioned to present the row of type on which the preselected character is located to face platen 26 and is then driven forward with impacting force toward the platen by arm 22, controlled by means not shown.

During the impacting motion and after type carrier 10 has been positioned to present the preselected character for printing, pivot lever 46 is actuated, carrying detent arm 48 to drive tilt positioning detent tooth 50 into recesses 37, 41 formed between teeth 36, 40 of tilt bridge 20 and print deflection blocking arm 38, as shown in FIG. 3. Detent tooth 50 provides a camming surface against which teeth 40 of print deflection blocking arm 38 ride and are cammed upwardly and outwardly, raising print deflection blocking arm 38 so that upper surface 43 of recess 42 of the arm is lifted off of its resting position on upper surface 35 of finger 34 of tilt bridge 20 and also so that the upper surface 45 of abutment 44 of print deflection blocking arm 38 rests against lower print deflection blocking surface 33 of rotation detent teeth 32, as shown in FIG. 1. In this position, detent tooth 50 detains print deflection blocking arm 38 firmly so that a downward tangential escape of type carrier 10 is reliably prevented during printing. Blurring or smearing of the type character is thus prevented.

Detent tooth 50 has the additional function of finally and precisely positioning the described character in the tilt direction. If, prior to printing, type carrier 10 is tilted too far so that tilt correction is required in the counterclockwise direction as viewed in FIG. 1, detent tooth 50 encounters the appropriate tooth 36 on tilt bridge 20 and tilts the type carrier counterclockwise as pivot lever 46 drives detent tooth 50 into print position. Type carrier 10 will thus be rotated so that blocking surface 33 formed by rotational detent teeth 32 moves downwardly to meet upper surface 45 of abutment 44 of print deflection blocking arm 38 being driven upwardly by the action of detent tooth 50 against teeth 40. The type carrier and blocking arm come to rest in the position shown in FIGS. 1 and 3, with the type carrier finally and precisely positioned for printing the desired character.

If, however, type carrier 10 is tilted too little so that tilt correction is required in the clockwise direction, as viewed in FIG. 1, clockwise positioning of type carrier 10 is effected by the action of detent tooth 50 driving upper surface 45 of abutment 44 of arm 38 against blocking surface 33 of the type carrier. As the type carrier is tilt positioned, tooth 36 of tilt bridge 20 is rotated along with the type carrier, and comes to rest against detent tooth 50, as shown in FIG. 3, when the type carrier is correctly tilt positioned to print the desired character. Thus, during final clockwise tilt positioning, detent tooth 50 does not encounter teeth 36 of tilt bridge 20 until the positioning has been completed due to the position of teeth 36 and to the size and configuration of recesses 37 relative to the size of detent tooth 50.

Once the type character has been printed, detent lever 46 and detent arm 48 are returned to the disengaged position, disengaging detent tooth 50 from teeth 36, 40 of tilt bridge 20 and print deflection blocking arm 38, allowing print deflection blocking arm 38 to fall to the rest position, and disengaging surface 45 of abutment 44 from print deflection blocking surface 33 of rotation detent teeth 32. Thereafter, when a new rotational indexing is performed, there is no friction between print deflection blocking arm 38 and type carrier 10.

In the embodiment illustrated in FIG. 4, abutment 44' of print deflection blocking arm 38' is provided with a dimple or protrusion 52 extending upwardly from upper surface 45' of the abutment for rotational detention of type carrier 10 at a selected column in cooperation with rotation detent teeth 32 of the type carrier and for simultaneous print deflection blocking of the type carrier.

In the embodiment of FIG. 5, abutment 44'' of print deflection blocking arm 38'' is provided with a ball 54, which protrudes through the upper surface 45'' of abutment 44'' through a hole 56 in the abutment. Ball 54 is retained in the small diameter notched hole 56 by a flat spring 58 which is fastened as by retaining means 60 to the abutment. Ball 54, similar to the embodiment of FIG. 4, simultaneously rotationally detents the type carrier in cooperation with rotation detent teeth 32 of the type carrier and blocks downward tangential movement of the type carrier during printing.

I claim:

1. In a single element printer comprising a hollow inverted cup-shaped type carrier having type characters on its outer periphery located in rows and columns, a platen, a tilt bridge axially supporting said type carrier for rotational movement to position a selected column of type characters opposite said platen, said tilt member having detent teeth thereon, support means pivotally supporting said tilt bridge for tilting movement about a tilt axis to position a selected row of type characters opposite said platen;

said support means being movable from a rest position to a printing position to impact a selected type character against said platen, said type carrier on impact experiencing deformation with lower portions tending to move tangentially relative to said platen and support member, said type carrier having a blocking surface located in a radial plane, a blocking arm freely pivotally supported on said tilt axis having a radially extending abutment located opposite the platen and proximately beneath and spaced from said blocking surface for arresting tangential movement of said typehead relative to said platen and relative to said support member on impact of a selected type character against said platen, means on said tilt bridge and said blocking arm for supporting said blocking arm spaced from said blocking surface, said blocking arm having teeth which extend between the detent teeth on said tilt bridge, and tilt detent means movable into engagement with detent teeth on said tilt bridge and teeth of said blocking arm for moving said blocking arm and its abutment into engagement with said blocking surface and for finally tiltably positioning said tilt bridge.

2. In a printer as recited in claim 1, wherein said means on said tilt bridge and said blocking arm comprise a finger on said tilt bridge and a recess formed in said blocking arm for receipt of said finger, said recess having a dimension greater than the width of said finger so as to allow relative movement between said blocking arm and said tilt bridge.

3. In a printer as recited in claim 1, wherein said detent means includes a detent tooth movable to enter between a tooth of said tilt bridge and a tooth of said blocking arm to move said blocking arm abutment into engagement with said blocking surface and to finally tiltably position said tilt bridge.

4. In a printer as recited in claim 1 wherein said blocking surface on said type carrier is defined by the lower extremities of a plurality of rotational detent teeth formed on said type carrier.

5. In a printer as recited in claim 4 wherein said abutment is provided with a protrusion for rotational detent engagement with the rotational detent teeth of said type carrier.

6. In a printer as recited in claim 5 wherein said protrusion is a dimple formed on the abutment.

7. In a printer as recited in claim 5 wherein said protrusion is the surface of a ball protruding through a hole formed in said abutment.

* * * * *